US010676948B1

(12) United States Patent
Nash, Sr.

(10) Patent No.: US 10,676,948 B1
(45) Date of Patent: Jun. 9, 2020

(54) SWIMMING POOL SKIMMER GUARD

(71) Applicant: Franklin Delano Nash, Sr., Silver Spring, MD (US)

(72) Inventor: Franklin Delano Nash, Sr., Silver Spring, MD (US)

( * ) Notice: Subject to any disclaimer, the term of this patent is extended or adjusted under 35 U.S.C. 154(b) by 0 days.

(21) Appl. No.: 16/018,241

(22) Filed: Jun. 26, 2018

(51) Int. Cl.
*E04H 4/12* (2006.01)

(52) U.S. Cl.
CPC ..... *E04H 4/1272* (2013.01); *E04H 4/1254* (2013.01)

(58) Field of Classification Search
CPC ..... E04H 4/1272; E04H 4/1254
USPC ..... 210/167.12, 167.19, 232, 238
See application file for complete search history.

(56) References Cited

U.S. PATENT DOCUMENTS 4,369,109 A * 1/1983 Edge ..... B01D 29/96 210/167.19
5,173,181 A * 12/1992 McFarland ..... B01D 29/27 15/1.7
6,770,193 B2 8/2004 Foley
6,989,093 B1 * 1/2006 Greathead ..... E04H 4/1254 210/167.19
6,989,094 B2 1/2006 Knapp et al.
7,052,602 B2 5/2006 Boggs et al.
7,594,997 B1 * 9/2009 Kazarian ..... E04H 4/1254 210/167.19
2008/0230453 A1 9/2008 Szymczak et al.
2011/0094973 A1 * 4/2011 Conti ..... B01D 29/27 210/776
2012/0187029 A1 7/2012 Lauro et al.
2013/0186812 A1 7/2013 Fitzpatrick et al.
2014/0231324 A1 8/2014 Griffin

* cited by examiner

*Primary Examiner* — Fred Prince
(74) *Attorney, Agent, or Firm* — Oliver Edwards; Law Office of Oliver Edwards LLC

(57) ABSTRACT

An in-pool swimming pool skimmer/skimmer basket, weir, pump-motor/basket, water-inline and water intake inlet debris clog reduction embodiment system, that's size/shaped to be placed in-front of a pool skimmer/plate, unattached inside a pool. The embodiment has a geometric shape-correspondent to a pool skimmer, said with a flexible fabric that has apertures that is molded into it or fits over its frame. The Main Body Shaft© mass has optional embodiments (handle, various lengths, extension, series, etc.). The present invention geometric length shape frame, the Master Head Net© assembled unit, with flexible aperture fabric, is deployed over the top edge of a pool and in front of pool skimmer/plate from above ground. When used at different angles, it's a multiple tool unit in one, a skimmer/weir, water intake debris stopper/guard, a pool leaf rake or leaf skimmer, etc.

19 Claims, 7 Drawing Sheets

SWIMMING POOL SKIMMER GUARD

BACKGROUND OF INVENTION

The present invention generally relates to a Debris-Shield-Protector-Blocker-Guard, System Clog reducer, Deflector Embodiment System Device Apparatus for use in a Swimming Pool in front of Skimmer Intake, its Skimmer Basket, its water in-lines, the Weir, Pump and Motor debris Basket. Especially for reducing, stopping and or preventing non-water type items from being received into the filtration system through the pool skimmer, weir, etc., causing problems or requiring costly and expensive repairs. The present invention is a multiple purpose one piece unit pool tool, that is of multiple section and of varying length/size parts that are joined in known manners and means, whereas and when combined and or is molded as a one piece unit, has multiple functional capabilities for use by a pool owner who can use it in numerous ways.

SUMMARY OF INVENTION

The present invention is researched and developed by the inventor, an owner of multiple pools, to serve as a one piece unit tool, for multiple purpose pool maintenance operations, especially if pool owner is away from their pool for an extended time. The pool owner and or end user, does not have to use multiple tools or devices by and through interchanging different devices on one or several pole(s), to accomplish the multiple functions of present invention. Prior art does not provide the present invention multiple uses and purposes in a, or as a one piece unit. Present invention is designed to be a pools skimmer guard, a skimmer basket protector, the pool weir guard, a water intake line guard, a pump basket guard, pool motor shield, a water surface rake, a vertical debris remover, a leaf skimmer, etc., which can/does receive debris daily or when owner is away multiple days for example, thus Skimmer Basket, Weir, etc., fills with debris.

Present invention is designed with its embodiment member parts to achieve said functions as is and will be stated and described herein through drawings/illustrations and other means and methods and said is not to be limited in scope of/by functions or purposes, but to enhance and further the understanding of said present invention.

DESCRIPTION OF PRIOR ART

U.S. Pat. No. 6,770,193 B2, issued to Kevin Foley, on Aug. 3, 2004, the Pool Skimmer Barrier Device, is a device for a pool to prevent debris on the pool water surface from entering the pool skimmer intake and said is different in shape-design-application from present invention.

U.S. Pat. No. 6,989,094 B2, issued to Shepherd Knapp/Cynthia Knapp, on Jan. 24, 2006, the Pool Skimmer Screen is different from present invention in that, one it does attach to the pool wall.

U.S. Pat. No. 7,052,602 B2, issued to Karen Boggs/Gary Boggs, on May 30, 2006, the Skimmer Intake Guard for a swimming pool or hot tub, is different in that it attaches to the water intake through the use of its hooks, the present invention does not have said type hooks.

US Patent App. Pub. No. 2008/0230453 A1, by John D. Szymczak/Jackie Szymczak on Sep. 25, 2008, the Pool skimmer Debris Gate, is different in design, method of use in that it has a door which opens and closes, whereas the present invention does not.

US Patent App. Pub. No. 2012/0187029 A1, by Ken Lauro/Richard Maiaro, on Jul. 26, 2012, the Pool Skimmer intake with electronic accessories, is different in that the present invention has no electronic mechanisms.

US Patent App. Pub. No. 2013/0186812 A1, by Michael Fitzpatrick/Robert Merritt, on Jul. 25, 2013, the Swimming Pool Skimmer Leaf Restraint, is different in design one by forming a round barrier another it connects to the skimmer box, whereas the present invention does not.

US Patent App. Pub. No. 2014/0231324 A1, by Alan Griffin, on Aug. 21, 2014, the Pool Skimmer Protector, whereas the present invention is different in design, does not have a moveable flap type method for use.

DETAILED DESCRIPTION

Figure 1:
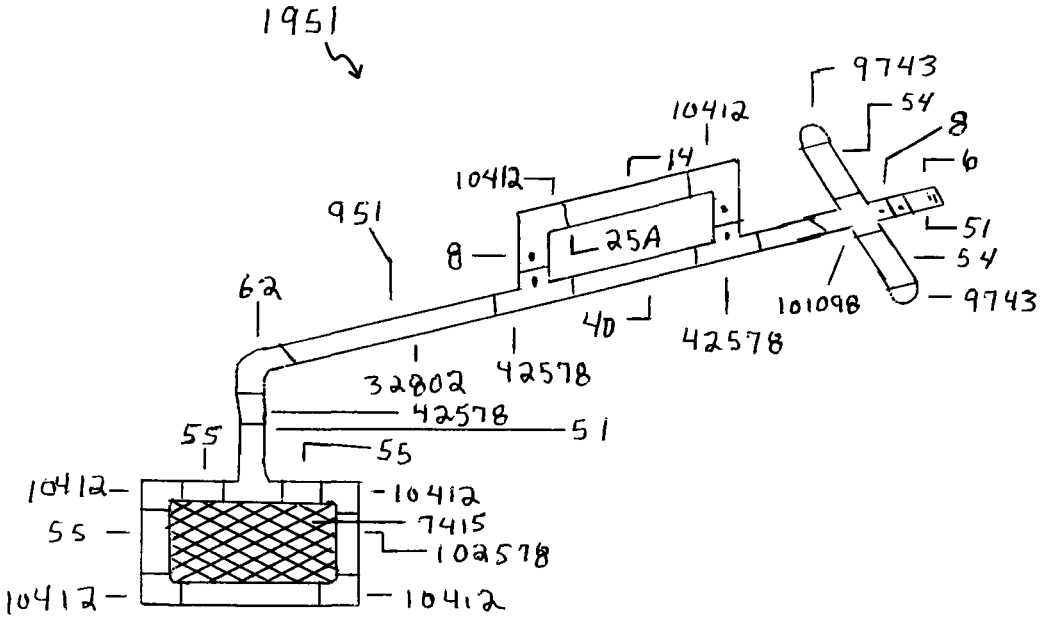
FIG. 1 is an overall top side frontal angle view of present invention of a series of embodiments, featuring its one hundred eighty degrees Main Body Shaft in comparison to its adjacent and ninety degree shape, E-Z Handle unit, a "Tee-Back" style type with its stabilizing side elements embodiments, its geometric shape Main Body Shaft, its geometric shape frame-Master Head Net mesh net and said is constructed of known type pipe/parts [round or flat, etc.,] and such with corresponding known fittings size elbows/tee types, couplings, pipe caps, etc., with said to be of various sizes/lengths, parts and of known material which can determine Series.

FIG. 1 is an overall top side frontal angle view of present invention the Pool Beaver Deluxe E-Z Handle Series 1951 as a one piece unit (36"-48" in length×15" wide net), with a series of its embodiments, featuring its one hundred eighty degrees Main Body Shaft lengths 951 with its E-Z Handle one piece shaped handle unit 14 (consisting of embodiment parts 8 interior pipe part, 42578 end tee, 25A handle top length and a 40 Main Body Shaft middle length), a "Tee-Back" 101098 style type with its stabilizing side element embodiments 54, its geometric shape Main Body Shaft 951, its geometric shape frame-Master Head Net 102578 (consisting of 10412 elbows, 54 stabilizing lengths and 42578 end tee), flexible fabric mesh net 7415 inlaid into said frame and said is constructed of known type pipe/parts (round/flat, etc.), and such with corresponding known fittings size elbows 10412, style tee types 101098/42578, couplings 51, pipe caps 9743, etc., with said to be of various sizes/lengths and other embodiment parts such as the 62 slip screw elbow, 6 perforated lines indicates threads, 8 indicates an interior pipe fitting or the like to/for connecting embodiment members in known manners, 54 stabilizer length, 40 Main Body Shaft middle length, 55 Master Head Net length, and of known material which can determine Series.

Figure 1A:
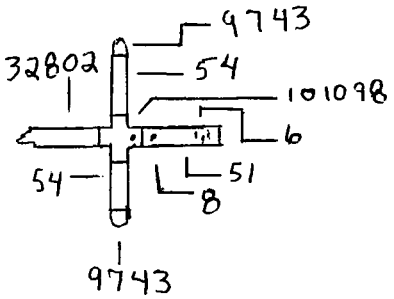
FIG. 1A is an overall top side angle cut away view of present invention at what is to be considered the rear end of Main Body Shaft embodiment member, less its Aft Extension embodiment member and said end has interior connection aspects allowing movement and featuring its optional Cross T-Back style type, its Stabilizing side element embodiment members unit.
Figure 1B:
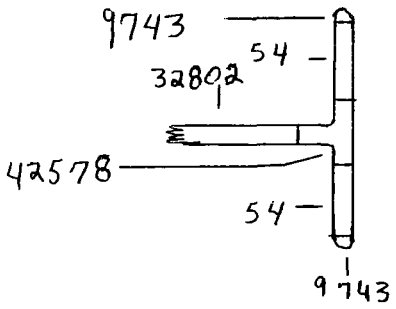
FIG. 1B is an overall top side angle cut away view of present invention of what is to be considered its embodiments Rear Main Body Shaft member aspects featuring its optional Cross Tee-Back End unit style type, its Stabilizing side element embodiment members unit and its embodiments.

FIG. 1A is an overall top side angle cut away view of present invention 1951 at what is to be considered the rear end of Main Body Shaft embodiment member 951, less its Aft Extension embodiment member unit 3507 (consist of 9743, 54 stabilizing length, 51 slip screw coupling) and a said end has 6 threads for connections, featuring its optional Cross Tee Back style type 101098, its Stabilizing side element embodiment members as a unit 54 (consist of a portion of a tee, stabilizing length section, 9743 end cap).

Figure 2:
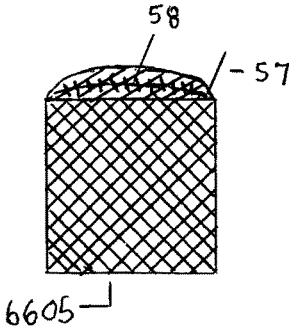
FIG. 2 is a birds eye view of a type of know type flexible mesh/fabric/nylon geometric shaped zipper-able bag.

FIG. 2 is a birds eye view of a type of know flexible fabric mesh 7415 of cotton/nylon etc., geometric shaped bag with a zipper 6605 (bag can have other types of closure mechanisms/hook-loop, etc.) and also shown is the zipper unit 58 and the zipper handle 57.

Figure 2A:
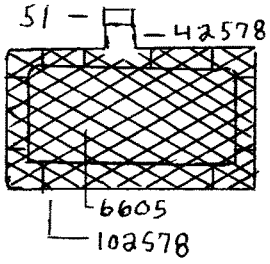
FIG. 2A is an upright frontal angle view of a type of know flexible mesh/fabric/nylon, etc., geometric shaped zipper bag placed over present invention geometric shape molded master net head frame unit, the Master Head Net mesh net frame.

FIG. 2A is an upright frontal angle view of a type of know flexible mesh 7415/fabric/nylon, etc., where a geometric shaped zipper bag 6605, with its zipper handle 57 is placed over present invention geometric shape molded/formed master head net frame unit 102578 the Master Head Net 102578 mesh net frame (bag can have other types of closure mechanism-hook-loop, etc.), with a slip screw coupling 51.

Figure 3:
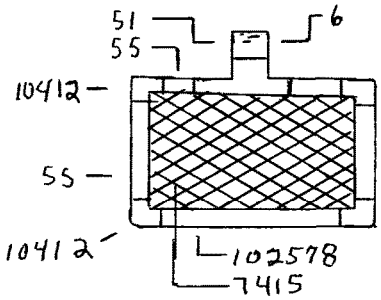
FIG. 3 is a frontal angle view of a geometric shape molded frame of pieces joined in known manner to form a one piece unit (not shown here is the molded one piece unit), thus the master head net frame, with a flexible mesh/net type fabric with apertures or the like that is molded into the/its frame work and also featured is that which is to be considered the/its tee type neck embodiment member section unit, where the present invention ninety degree geometric embodiment element is connected/attached to the Main Body Shaft in a known means/manner).

FIG. 3 is a frontal angle view of its geometric shape molded/formed head net frame holder 102578, where has a flexible mesh/net type fabric 10412 with apertures or the like that is molded into its frame 102578 work also illustrated is its neck connection section 42578 and its slip screw coupling 51 with 6 thread aspects, where present invention ninety degree embodiment member part 62 is to be used to connect to the geometric Master Head Net frame 102578 embodiment member element in conjunction with 51 slip screw coupling, which Is to be connected and attached to its Main Body Shaft 951 frontal length 32802 in known means/manner, thus and therefore forms the one piece present invention, the "Pool Beaver" unit 1951.

Figure 4:
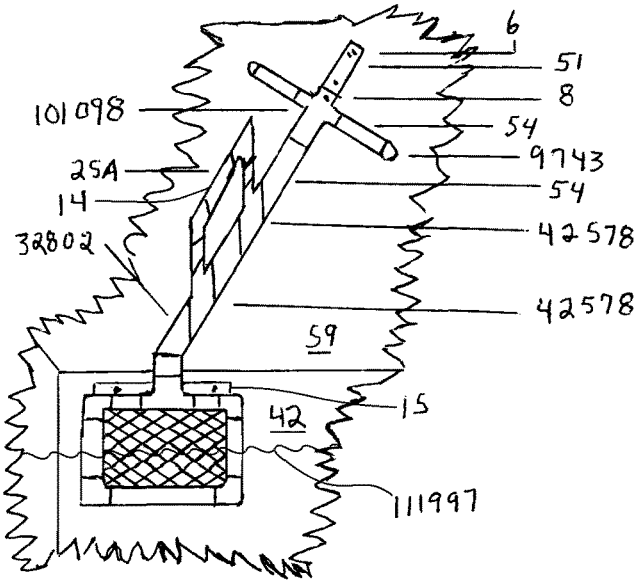
FIG. 4 is a top side angle cut away view representing a swimming pool with a water level line and a sidewalk type edge, where the Main Body Shaft is placed with one of its "Tee" Back style type embodiment members section is in view and the Main Body Shaft with its geometric shape frame Master Head Net member is installed in and on a pool with its Master Head Net assembly member being correctly and properly in front of a pool skimmer/skimmer plate interiorly and where the pool water returns to its filtration area at the weir door area.

FIG. 4 is a top side angle cut away view of a complete one piece unit of present invention 1951 as a one piece unit, representing a swimming pool sidewalk top type edge 49, with a view of a style type of its "Tee" Back embodiment members section 101098 on it and the total Main Body Shaft length 951 of present invention 1951 is installed on a pool side and with its Main Body Shaft with a handle 14 unit of the Pool Beaver Deluxe E-Z Handle Series 1951, which is joined to its Master Head Net 102578 with flexible fabric mesh net 7415 through its ninety degree embodiment member 62 and with its Master Head Net 102578 flexible mesh net 7415 in front of a pool side skimmer/plate 15, water return/weir area 42 and also illustrated is 111997 a water line, 51 slip screw coupling, 16 skimmer plate screw/bolt.

Figure 5:
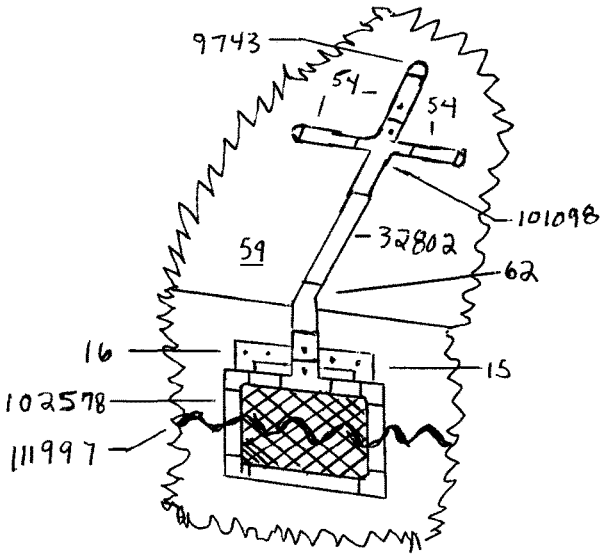
FIG. 5 is a top side angle cut away view of a pool sidewalk and present invention, representing a swimming pool sidewalk top type edge, with a view of present invention style type of its "Tee" Back embodiment member section connected to the Main Body Shaft mass of present invention and said is installed on a pool side with its Main Body Shaft mass lengths which is joined to its ninety degree elbow embodiment member and said is connected to its Master Head Net mesh net geometric shape frame and said is in front of a pool side skimmer/water return and weir area (this is not the Pool Beaver Deluxe Handle Series).

FIG. 5 is a top side angle cut away view of the Pool Beaver-"Shortie Series" (19"-20" in length) unit 005 part, in according to the Main Body Shaft 951 shaft lengths, various embodiment members, in a swimming pool sidewalk type edge 59, where the Main Body Shaft 951 is placed with its Cross "Tee" Back, 101098 style type of embodiment members section and in view is the Main Body Shaft, 951 with its geometric shape frame Master Head Net 102578 member, that's installed in and on a pool with its Master Head Net, 102578 correctly and properly in front of a pools skimmer/skimmer plate 15 interiorly, where the pool water returns and the weir door area 42 is.

Figure 6:
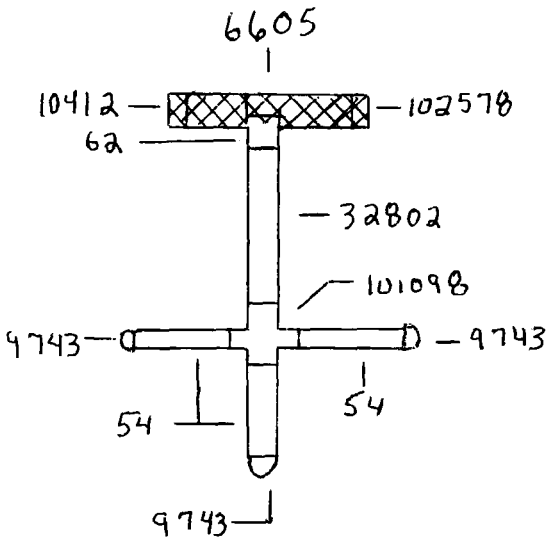
FIG. 6 is a birds eye view of present invention the Pool Beaver-"Shortie Series", (005)-part as in according to its Main Body Shaft shaft length (series shorter in length over-all), featuring its Cross-Back "T" type as well as the top of its ninety degree embodiment member where/for its Master Head Net, mesh net geometric frame and it has its Master Head Net attached adjacently which can be detached/attached in known method and manner.

FIG. 6 is a birds eye view of present invention the Pool Beaver-"Shortie Series" (19"-20" in length) unit 005, in according to the Main Body Shaft, 951 shaft lengths, various embodiment members, the Pool Beaver 1951 with a Cross Back "Tee" 101098 style type embodiment member unit and with unit 54—which consist of a stabilizing length that's capped 9743 as an embodiment member with its Master Head Net 102578 mesh net 6605 unit and said is connected with/to its Main Body Shaft 951 lengths, through its ninety degree embodiment member 62 and with its zipper over-bag mesh net bag 6605 that's over its geometric shape frame assembly unit 102578 and the Master Head Net assembly 102578 of present invention when embodiments are combined, thus, the Pool Beaver 1951 mesh net frame with 102578.

Figure 7:
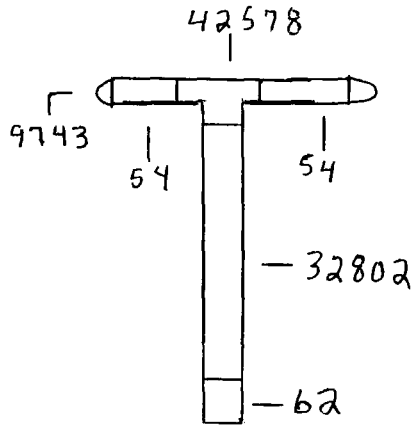
FIG. 7 is a birds eye view of present invention Cross "Tee" Back End style type embodiment members unit, with its opposite/opposing side capped stabilizing lengths embodiment members unit, but without its Master Head Net embodiment member assembly unit.

FIG. 7 is a birds eye view of the present invention the Pool Beaver-"Lil Beaver Series" (29"-30") (Standard unit) 007 part in according to the Main Body Shaft 951 shaft lengths, various embodiment members, with a "Tee" Back End 42578 style type embodiment member without its Master Head Net flexible mesh net assembly 102578 attached and this view is not the Deluxe E-Z Handle Series 1951.

Figure 8:
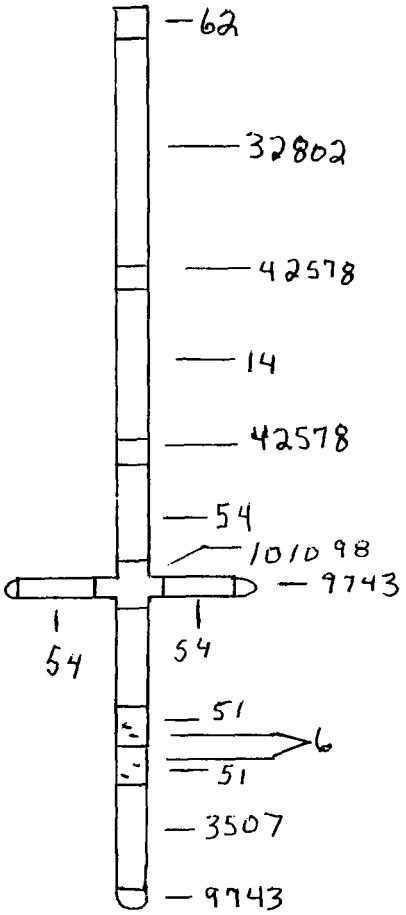
FIG. 8 is a birds eye view of present invention with a view of a style type of its Cross "Tee" Back embodiment section with capped ends, featuring the Stabilizing side lengths embodiment members unit, aspects that's on and part of its Main Body Shaft length that's joined with the Pool Beaver handle—the Deluxe E-Z Handle Series, the end opposite the Master Head Net mesh net and ninety degree embodiment member connection end has its connection embodiment member end for connecting its Aft Extension end section.

FIG. 8 is a birds eye view of the complete unit Pool Beaver Main Body Shaft, 1951 assembly and in accordance to its combined Main Body Shaft 951 lengths and its embodiment members shown, it's the Deluxe E-Z Handle Series 1951, also viewed is the handle assembly 14, its Cross "Tee" back style type embodiment member 101098 with its side stabilizing members units 54 with their end closure caps 9743, but without its Master Head Net 102578 with flexible fabric mesh net assembly 7415 attached and also viewed is the Pool Beaver 1951 Aft Extension embodiment member unit (consist of a stabilizing length 54, a capped end 9743, a slip screw coupling 51 with thread aspects 6), thus the 3507 unit, which is attached to the Pool Beaver, Main Body Shaft rear area assembly 1951 and is detachable/attachable in known method/means and also seen indicated is perforated lines 6 representing threads of a known type for twisting/receiving for connecting parts and the Pool Beaver Main Body Shaft assembly 1951 can be of known telescopic in nature and have known V-Clips mechanisms (not shown herein) with all herein stated, described and indicated/illustrated purposes.

Figure 9:
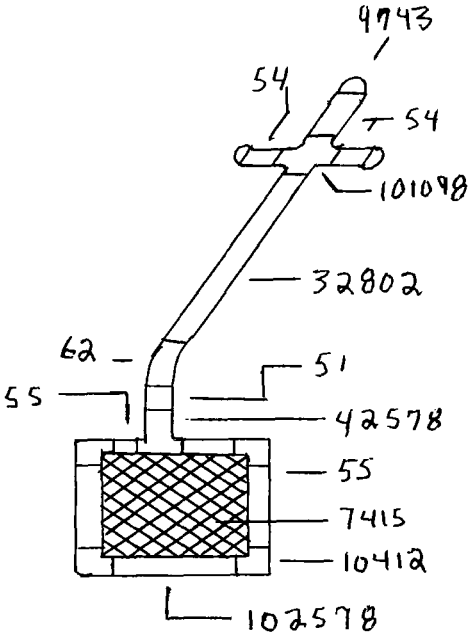
FIG. 9 is a top side angle view of present invention with its opposite Master Head Net end, in a slighted elevated horizontal position (somewhat at a forty five degree angle, in comparison to ground level), for raking water surface debris.

FIG. 9 is a top side angle view, representing present invention unit 1951 "Lil Beaver Series", the standard unit 007 (29"-30"), in accordance to its combined Main Body Shaft 951 lengths, with what is to be considered the Main Body Shaft 951 with a unit 54 stabilizing lengths with its capped 9743 embodiments, seen also is the section area opposite the end of where the Master Head Net 102578 with its 55 side lengths is connected to the Main Body Shaft lengths 951 through its ninety degree embodiment member 62, in a or at a slighted elevated horizontal angled position known and understood as a person's raking position (estimated forty five degree angle from ground level), for the purpose of raking the water surface line 111997 for surface debris removal.

Figure 10:
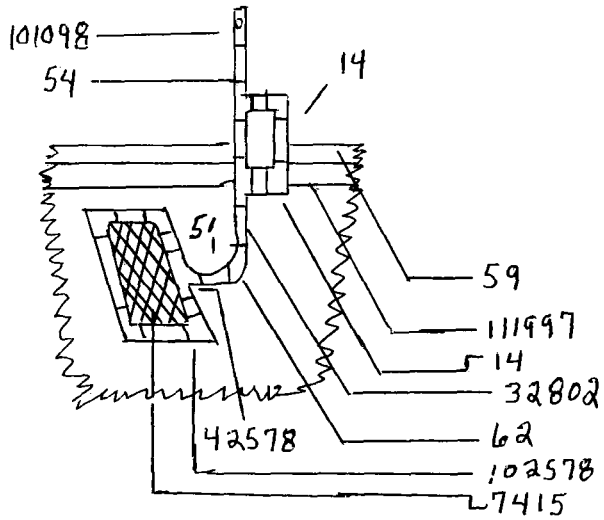
FIG. 10 is a top side cutaway angle view of the inside of a swimming pool area and the present Invention being illustrated in its vertical position, highlighting its capability of being below pool indicated water line level and/with it being able to be vertically lifted to remove pool debris.

FIG. 10 is a top side angle view of present invention 1951 depiction of it as a one piece unit, with it being submersed below the pool surface water level line 111997 and it being used in a vertical position and manner from below the pool surface water level 111997, for the purpose of lifting upward pool debris vertically for the removal of said debris.

Figure 11:
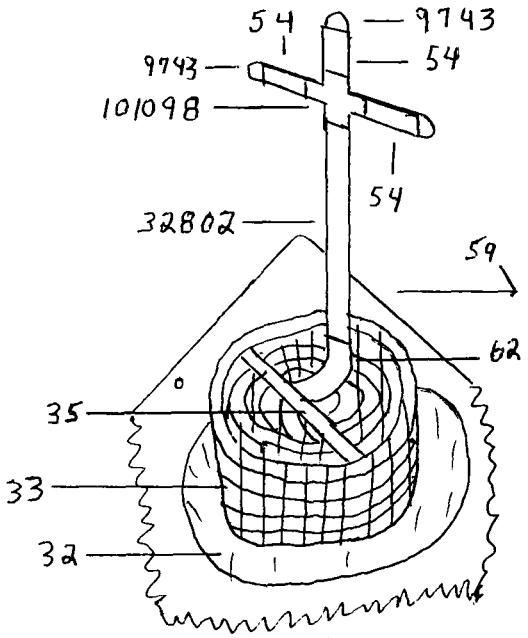
FIG. 11 is a top side angle view of present invention the Pool Beaver, in its vertical position removing a Skimmer Basket from an in-ground Skimmer Basket Holder in the pool water return area through the use of its ninety degree angled embodiment member that the Master Head Net embodiment would be attached, however, this can occur when the Master Head Net embodiment is detached from its ninety degree angled embodiment member.

FIG. 11 is an top side cutaway of a pool sidewalk 59, where it's an angle view of present invention 1951 "Lil Beaver Series" (29"-30"), in accordance to the Main Body Shaft 951 shaft lengths, various embodiment members, and without its geometric shape frame Master Head Net 102578 with its flexible fabric mesh net assembly member unit 7415 or 6605 embodiment and present invention Series unit part 007 the "Lil Beaver Series", is in its vertical position and it being demonstrated to be used for removing a pool Skimmer Basket 33 from the in-ground Skimmer Basket Holder Aperture 32 by its Skimmer Basket Handle 35 in the water return/weir area 42 with/by its ninety degree embodiment member 62 (elbow embodiment fitting member 62), when its Master Head Net 102578 embodiment assembly is not connected to the Main Body Shaft 951 member.

Figure 12:
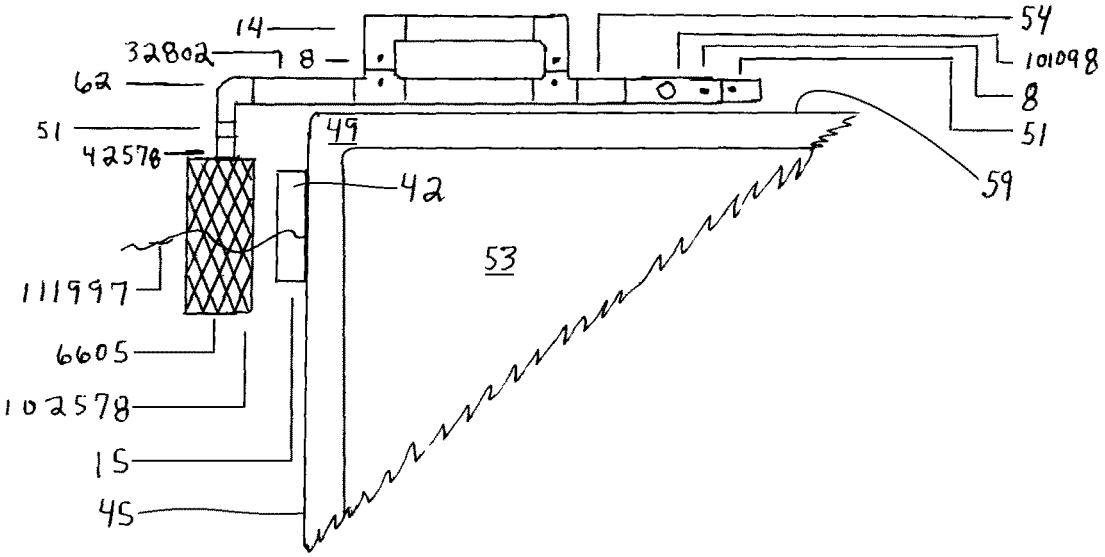
FIG. 12 is a cut away side angle view of an in-ground swimming pool side wall/side walk, featuring present invention Deluxe E-Z Handle Series installed in/on an in-ground pool, with its Master Head Net flexible mesh net placed in front of a pool side wall skimmer/skimmer plate, water return and weir door area assembly and shown is a water level line, its Cross "Tee" embodiment member unit with its Stabilizing length capped end (illustrated is the Pool Beaver Deluxe E-Z Handle Series unit).

FIG. 12 is a cut away side angle view of a pool retainer side wall/sidewalk top 49 and ground 53, the side of a skimmer plate 15 and a water level line 111997 and it highlights present invention 1951 in accordance to its Main Body Shaft 951 lengths and its embodiments, it's the Deluxe E-Z Handle Series 1951 with its Main Body Shaft 951 with its Cross "T" 101098 back style types with its end cap 9743, its ninety degree angle embodiment 62, its Master Head Net 102578 with its connecting neck embodiment members 51/42578 for connecting it to the Main Body Shaft 951 and with its embodiment members that connects to its one piece unit handle 14, of the Deluxe E-Z Handle Series 1951 unit embodiment members and said unit is installed in an in-ground pool with Its geometric shape frame Master Head Net 1951 with its flexible mesh net 6605 being placed properly in front of pool interior side wall 45 skimmer/skimmer plate 15, water return/weir door area 42 and said highlights a water level representation 111997 crossing the geometric shape frame Master Head Net 102578 with flexible fabric mesh net embodiment member 6605 as when the one piece unit the present invention 1951 is in use in its correct position.

Figure 13:
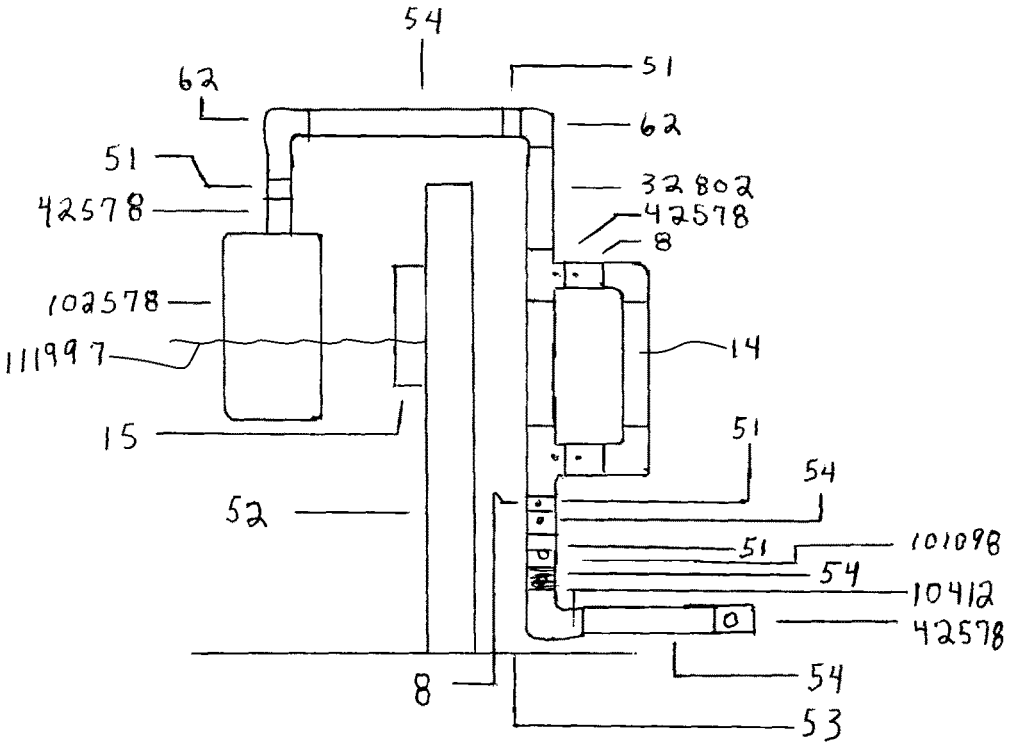
FIG. 13 is a cutaway side angle view of present invention the Pool Beaver, with the Pool Beaver Above Ground Adapter Unit Kit of the Pool Beaver, which has Leg and Foot Kit embodiment members which forms its unit parts kit and said is being used in conjunction with its other embodiment members to accommodate its use on/in an above ground pool.

FIG. 13 is a side angle cutaway view of the complete present invention the Pool Beaver 1951 with its above-ground pool kit on ground 53, the Pool Beaver Leg Adapter, consisting of 62, 54, 51 thus forming a unit with members herein being referred to as 63 in a combined embodiment state and Its Pool Beaver Foot Adapter (consisting of 62/10412, 54, 51, 42578 or 101098) thus forming a unit with members herein being referred to as 64 In a combined embodiment state and is combined to a complete 1951 for above ground pool members which is attachable/detachable with thread-able, twistable capabilities, thus said forms the embodiment members Kit, with various lengths and all coincide with other aspects herein according to end users pool height when in use as, in and or on an above ground pool to allow the Master Head Net 102578 with its flexible net assembly 7415/6605 to be placed in front of the above ground (pool wall 52) skimmer plate 15, water return/weir area opening 42 as and with an in-ground pool application.

Figure 13A:
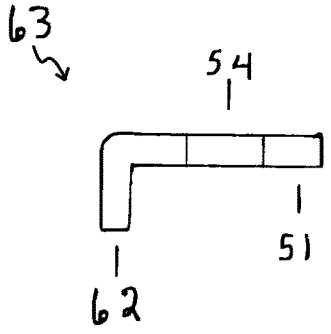
FIG. 13A is a side angle view of an embodiment parts/members of present invention, the Pool Beaver Above-Ground Leg Adapter Kit length embodiment members parts unit for a pool and its members varies in length and parts, but coincide with other aspects herein according to end users pool heights in use in/on the above ground pool to allow the Master Head Net, mesh net assembly to be placed in front of the above ground skimmer/skimmer plate, water return/weir opening as with an in-ground pool.

FIG. 13A is a side angle view of a complete present invention the Pool Beaver 1951 above-ground kit pool Leg Adapter 63 unit (stated in FIG. 13) embodiment members which is and has attachable/detachable, thread-able twistable capabilities and said has members that varies in length and parts, but coincide with other aspects herein according to end users pool heights when in use in/on an the above ground pool to allow the Master Head Net 102578 flexible mesh net assembly 7415/6605 to be placed in front of the above ground skimmer/skimmer plate 15, water return/weir area opening 42 as with an in-ground.

Figure 13B:
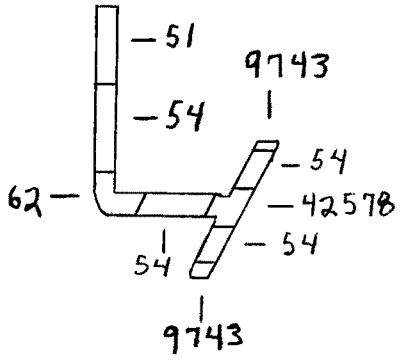
FIG. 13B is a side angle view of an embodiment parts/members of present invention, the Pool Beaver Above-Ground Foot Adapter Kite, length embodiment members parts unit for pools and its members varies in length and parts, but coincide with other aspects herein according to end users pool heights in use in/on the above ground pool to allow the Master Head Net mesh net assembly to be placed in front of the above ground skimmer/skimmer plate, water return/weir opening as with an in-ground pool.

FIG. 13B is a side angle view of present invention unit the Pool Beaver 1951 above-ground pool Foot Adapter 64 unit (stated in FIG. 13) length embodiment member unit parts which has attachable/detachable, thread-able twistable capabilities and said has members that varies in length and parts, but coincide with other aspects herein according to end users pool heights in use in/on the above ground pool to allow the Master Head Net 102578 mesh net 7415/6605 assembly to be placed in front of the above ground skimmer/skimmer plate 15, water return/weir area opening 42 as with an in-ground pool.

Figure 14:
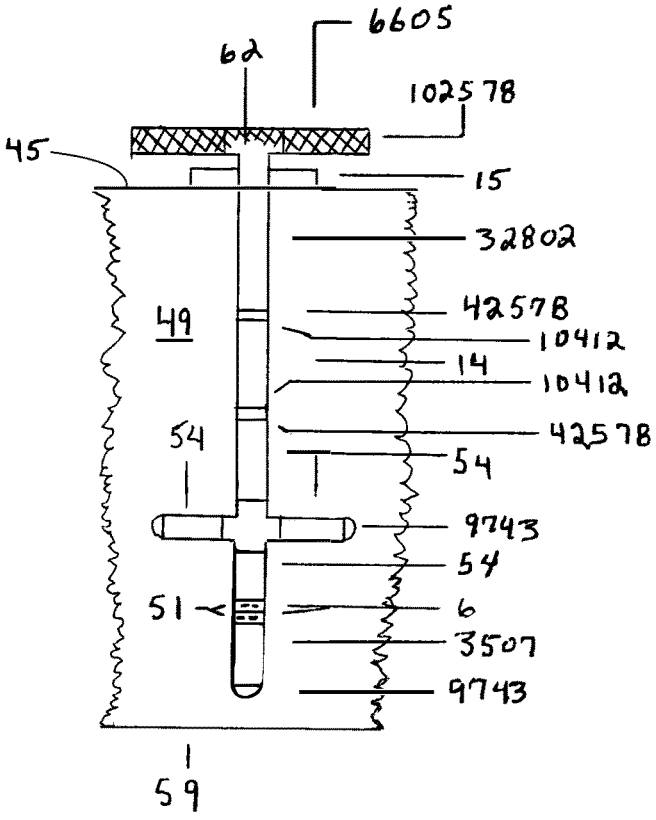
FIG. 14 is a birds eye view of present invention, the Pool Beaver Deluxe E-Z Handle Series, on a cutaway poolside sidewalk, featuring the connections of Main Body Shaft embodiment member parts (so as when said is combined into one unit it forms the present invention the Pool Beaver), that are joined in known methods to accommodate its Cross "Tee" style type, its Stabilizing side embodiment member parts and which, its Deluxe E-Z Handle Series/Main Body Staff that's joined to its Master Head Net flexible mesh net by its ninety degree embodiment member, which is joined with/to its Main Body Shaft lengths to/with the attached attachable end (detachable also), of the Main Body Shaft Extension lengths embodiment member parts that has a capped end and illustrated with the top of its geometric shape Master Head Net with a flexible mesh net over frame zipper bag net embodiment assembly unit and with it being shown in proper/correct position in front of a known swimming pool skimmer/skimmer plate, water return and weir door area.

FIG. 14 is a birds eye view of present invention the Pool Beaver 1951 Deluxe E-Z Handle Series, featuring its handle assembly unit 14 (refers to all embodiments that form said handle/tees, lengths, elbows and interior parts as in FIG. 1), that is parallel and above its Main Body Shaft 951 lengths embodiment member and said is joined to its ninety degree angled embodiment member 62 so that it accommodates its geometric shape Master Head Net 102578 flexible mesh net assembly 7415 member unit and also illustrated is its Main Body Shaft, lengths embodiment members 951, its Main Body Shaft rear length 54 unit stabilization embodiment, its Aft Extension embodiment member 3507 unit as stated herein and illustrated is the correct position of the Master Head Net 102578 with flexible mesh net assembly unit 6605 as in reference to the Main Body Shaft embodiment members 951 and as it should be when properly position in front of a swimming pools interior sidewall 45 skimmer/skimmer plate 15, the known water return/weir door area 42.

Figure 15:
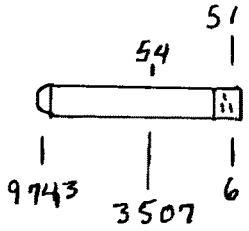
FIG. 15 is a birds eye view of present invention, the Pool Beaver Deluxe E-Z Handle Series Main Body Shaft, Aft Extension length embodiment member, featuring an embodiment version of its attachable/detachable end and its capped/closed ends (V-Clip connection embodiments options not shown herein).

FIG. 15 is a birds eye view of present invention Deluxe E-Z Handle Series 1951 Main Body Shaft Aft Extension 3507 unit (composed of its combined embodiment member parts), with its connectable end 6 (whereas its opposite end is capped/sealed), that is capable of being attached/detached to the Main Body Shaft 951 embodiment members unit in a known manner/means and shown is its non-connectable that's capped/closed appropriately.

Figure 16:
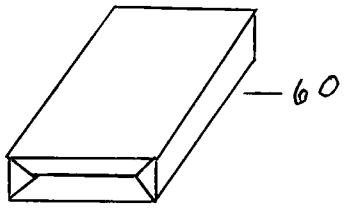
FIG. 16 features a top side angle view of a known sand bag/bag of sand or the like, that can be used as a type of many kinds of decorative weight types, that can be placed on present invention, the Pool Beaver rear end (the end opposite end of Master Head Net and its ninety degree embodiment member connection), if end user desires but and however it/they are not necessary or required for proper use of present invention to function in its intended stated purpose herein stated, illustrated, demonstrated, described, etc., when installed properly/correctly.

FIG. 16 features a top frontal side angle view of an optional and suggested type bag of sand 60 or the like, whereas said items that can be used as a type of many kinds of decorative weights that can be place on present invention the Pool Beaver 1951 Main Body Shaft 951 embodiment "Cross Tee Back" style type members 101098/42578, if end user desires but and however, it/they are not necessary or required for proper use or insulation of present invention as a complete one piece unit 1951 to function correctly and properly to achieve its maximum herein stated purpose/purposes and as illustrated herein.

Figure 17:
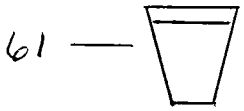
FIG. 17 features a top side angle view of a known flower pot or the like, that can be used as a type of many kinds of decorative weight types, that can be placed on present invention, the Pool Beaver rear end (the end opposite end of Master Head Net and its ninety degree embodiment member connection), if end user desires but and however it/they are not necessary or required for proper use of present invention to function in its intended stated purpose herein stated, illustrated, demonstrated, described, etc., when installed properly/correctly.

FIG. 17 feature a frontal angle view of an optional and suggested type of flower pot 61 item that can be used as a type of many kinds of decorative weights that can be place on present invention 1951, the Pool Beaver Main Body Shaft 951 lengths embodiment "Cross Tee Back" 101098/42578 style type member, if end user desires but and however, it/they are not necessary or required for proper use or insulation of present invention to function correctly and properly to achieve its maximum herein stated purpose/purposes and as illustrated herein.

Figure 18:
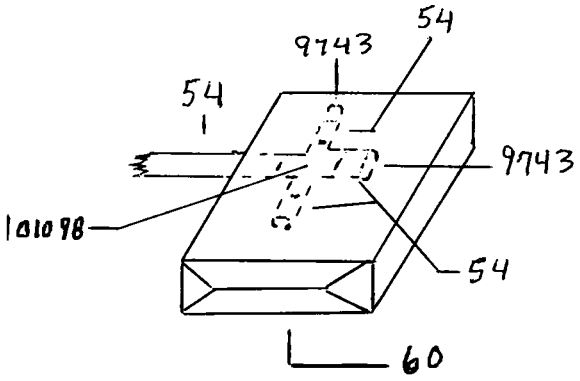
FIG. 18 features a top side angle view of a sand bag or the like, featuring it as though it is placed on the "Cross Tee Back" embodiment member of present invention, the Pool Beaver Main Body Shaft which is connected to its Master Head Net embodiment member of present invention as stated herein.

FIG. 18 features a top side angle view of a sand bag or the like, featuring it as though it is placed on the "Cross Tee Back" style type 101098/42578 embodiment member of the Pool Beaver Main Body Shaft 951 rear length section which is to be considered the opposite end of where its Master Head Net embodiments is and on a unit 54 as in shown in this illustration which has the Main Body Shaft 951 embodiment member of the 1951 in a cut away viewing position.

What is claimed herein is:

1. A pool skimmer guard comprising:

a mesh head frame defining an aperture and configured to substantially circumscribe a pool skimmer intake, a skimmer basket, a weir, a water intake inlet, or a pump debris basket;

a fabric mesh disposed on the mesh head frame and drawn across the aperture; and a shaft support structure attached to the mesh head, the shaft support structure configured to support the mesh head frame in-place circumscribing said pool skimmer intake, skimmer basket, weir, water intake inlet, or pump debris basket without attachment thereto or attachment to a pool wall or poolside deck;

wherein the mesh head frame and shaft support structure are attachably detachable from each other.

2. The pool skimmer guard according to claim 1, wherein the shaft support structure comprises one or more removable extension sections permitting the length of the shaft support structure to be adjusted.

3. The pool skimmer guard according to claim 2, wherein the removable extension sections are connected using slip screw connections.

4. The pool skimmer guard according to claim 1 further comprising an attachable skimmer basket handle, wherein the skimmer basket handle may be attached to the shaft support structure in place of the detached mesh head frame to permit the pool skimmer guard to be used for lifting and removing a skimmer pool basket from its holding seat platform.

5. The pool skimmer guard according to claim 1, wherein the shaft support structure comprises a Tee section to stabilize the pool skimmer guard.

6. The pool skimmer guard according to claim 5, wherein free ends of said tee section comprise end caps.

7. The pool skimmer guard according to claim 1, wherein said shaft support structure comprises an attachably detachable Aft Extension member disposed at an end distal to the mesh head frame.

8. The pool skimmer guard according to claim 1, wherein the fabric mesh comprises dual or more layers of flexible fabric for filtration.

9. The pool skimmer guard according to claim 1, wherein said fabric mesh is comprised of one or more materials selected from the group consisting of nylon, fiberglass, fabric, and polyurethane.

10. The pool skimmer guard according to claim 1, wherein said tee section is configured to accept placement of a decorative item, a flower pot, a sand bag, or other weighty item thereupon.

11. The pool skimmer guard of claim 1, wherein the mesh head frame and shaft support structure are attachably detachable by a slip screw fitting.

12. The pool skimmer guard of claim 1, wherein the fabric mesh comprises a bag configured to be zipper closed over the mesh head frame.

13. A pool skimmer guard comprising:

a mesh head frame defining an aperture and configured to substantially circumscribe a pool skimmer intake, a skimmer basket, a weir, a water intake inlet, or a pump debris basket;

a fabric mesh disposed on the mesh head frame and drawn across the aperture; and a shaft support structure attached to the mesh head, the shaft support structure configured to support the mesh head frame in-place circumscribing said pool skimmer intake, skimmer basket, weir, water intake inlet, or pump debris basket without attachment thereto or attachment to a pool wall or poolside deck;

wherein the shaft support structure comprises a ninety degree angle such that the mesh head frame may be disposed in the pool and the shaft support structure disposed substantially out of the pool;

wherein the shaft support structure comprises two additional bends configure to conform the shaft structure to a wall of, and an exterior ground surface of, an above ground pool.

14. The pool skimmer guard according to claim 13, wherein the mesh head frame and shaft support structure are attachably detachable from each other.

15. The pool skimmer guard of claim 14, wherein the mesh head frame and shaft support structure are attachably detachable by a slip screw fitting.

16. The pool skimmer guard according to claim 13, wherein said fabric mesh is comprised of one or more materials selected from the group consisting of nylon, fiberglass, fabric, and polyurethane.

17. The pool skimmer guard of claim 13, wherein the fabric mesh comprises a bag configured to be zipper closed over the mesh head frame.

18. A pool skimmer guard comprising:

a mesh head frame defining an aperture and configured to substantially circumscribe a pool skimmer intake, a skimmer basket, a weir, a water intake inlet, or a pump debris basket;

a fabric mesh comprising a fabric mesh bag configured to be zipper closed over the mesh head frame;

a shaft support structure attached to the mesh head, the shaft support structure configured to support the mesh head frame in-place circumscribing said pool skimmer intake, skimmer basket, weir, water intake inlet, or pump debris basket without attachment thereto or attachment to a pool wall or poolside deck, the mesh head frame and shaft support structure attachably detachable by a slip screw fitting; and a handle disposed on said shaft support structure.

19. The pool skimmer guard according to claim 18, wherein said fabric mesh is comprised of one or more materials selected from the group consisting of nylon, fiberglass, fabric, and polyurethane.

* * * * *